US010195809B2

(12) United States Patent
Cao et al.

(10) Patent No.: US 10,195,809 B2
(45) Date of Patent: Feb. 5, 2019

(54) PRESS-FIT DEVICE

(71) Applicants: BOE Technology Group Co., Ltd., Beijing (CN); Hefei BOE Optoelectronics Technology Co., Ltd., Anhui (CN)

(72) Inventors: Yunfa Cao, Beijing (CN); Bochao Jia, Beijing (CN); Yi Zhang, Beijing (CN); Pengjun Fang, Beijing (CN); Erpeng Wang, Beijing (CN); Guiyang Liu, Beijing (CN)

(73) Assignees: BOE Technology Group Co., Ltd., Beijing (CN); Hefei BOE Optoelectronics Technology Co., Ltd., Hefei (CN)

( * ) Notice: Subject to any disclaimer, the term of this patent is extended or adjusted under 35 U.S.C. 154(b) by 149 days.

(21) Appl. No.: 15/134,998

(22) Filed: Apr. 21, 2016

(65) Prior Publication Data

US 2016/0313581 A1 Oct. 27, 2016

(30) Foreign Application Priority Data

Apr. 24, 2015 (CN) ..... 2015 1 0205274

(51) Int. Cl.
*B30B 15/00* (2006.01)
*B30B 15/22* (2006.01)
*B30B 15/04* (2006.01)

(52) U.S. Cl.
CPC ..... *B30B 15/22* (2013.01); *B30B 15/041* (2013.01)

(58) Field of Classification Search
CPC .. Y10T 29/53974; B30B 15/22; B30B 15/041
See application file for complete search history.

(56) References Cited

U.S. PATENT DOCUMENTS 5,071,603 A * 12/1991 Kurumaji ..... B30B 15/20 264/328.7
2003/0155685 A1* 8/2003 Spengler ..... B29C 43/36 264/250

FOREIGN PATENT DOCUMENTS

CN 1501148 A 6/2004
CN 102209621 A 10/2011
(Continued)

OTHER PUBLICATIONS

Jan. 28, 2016—(CN)—First Office Action Appn 201510205274.9 with English Tran.

*Primary Examiner* — Richard Chang
(74) *Attorney, Agent, or Firm* — Banner & Witcoff, Ltd.

(57) ABSTRACT

The press-fit device includes a platform having an upper surface provided with a bearing base; a mounting rack disposed at the upper surface of the platform; a power cylinder mounted at the mounting rack, including a piston chamber, a piston rod and an actuating element intercommunicated with the piston chamber to provide pressure medium, wherein the piston rod is perpendicular to the bearing base; a guiding track disposed at the upper surface of the platform and arranged in parallel to the piston rod; and a press-fit plate disposed at one end of the cylinder rod and slidably sheathed on the guiding track, wherein a surface of the press-fit plate facing the bearing base is provided with a pressure base, and a surface of the pressure base facing the bearing base is provided with a press-fit frame and a pressure sensing device which is configured to detect a press-fit pressure.

9 Claims, 5 Drawing Sheets

(56) References Cited

FOREIGN PATENT DOCUMENTS

| | | | |
|---|---|---|---|
| CN | 102555408 | A | 7/2012 |
| CN | 202631897 | U | 12/2012 |
| CN | 102981289 | A | 3/2013 |
| CN | 203697645 | U | 7/2014 |
| JP | 1174319 | A | 3/1999 |
| JP | 2008286886 | A | 11/2008 |

* cited by examiner

PRESS-FIT DEVICE

This application claims priority to and the benefit of Chinese Patent Application No. 201510205274.9 filed on Apr. 24, 2015, which application is incorporated herein in its entirety.

TECHNICAL FILED

Embodiments of the present invention relate to a press-fit device.

BACKGROUND

During assembling a backlight module with a panel, it requires to perform a press-fit process. In existing press-fit devices, the panel and the backlight module are supported by separate mechanisms, respectively, and then aligned and bonded with each other. Such kind of press-fit devices neither can ensure that a final state of products upon aligning and press-fit satisfies industrial demands nor can monitor important control parameters in real time, which results in poor product yield.

SUMMARY

At least one embodiment of the present invention provides a press-fit device which can monitor important control parameters in real time while ensuring a backlight module and a panel to be completely bonded with each other.

Embodiments of the present invention provide technical solutions as below.

A press-fit device, comprising: a platform having an upper surface provided with a bearing base; a mounting rack disposed at the upper surface of the platform; a power cylinder disposed at the mounting rack above the bearing base, the power cylinder comprises a piston chamber, a piston rod, and an actuating element intercommunicated with the piston chamber to supply the piston chamber with pressure medium and control a pressure in the piston chamber, wherein the piston rod is perpendicular to the bearing base; a guiding track disposed on the upper surface of the platform and arranged in parallel to the piston rod; and a press-fit plate disposed at one end of the piston rod and slidably sheathed on the guiding track, wherein a surface of the press-fit plate facing the bearing base is provided with a pressure base corresponding to the bearing base, and a surface of the pressure base facing the bearing base is provided with a press-fit frame and a pressure sensing device, the pressure sensing device is configured to measure a press-fit pressure.

BRIEF DESCRIPTION OF THE DRAWINGS

Embodiments of the present invention will be described in more detail below with reference to the accompanying drawings to enable those skilled in the art to understand the present invention more clearly, wherein.

Figure 1:
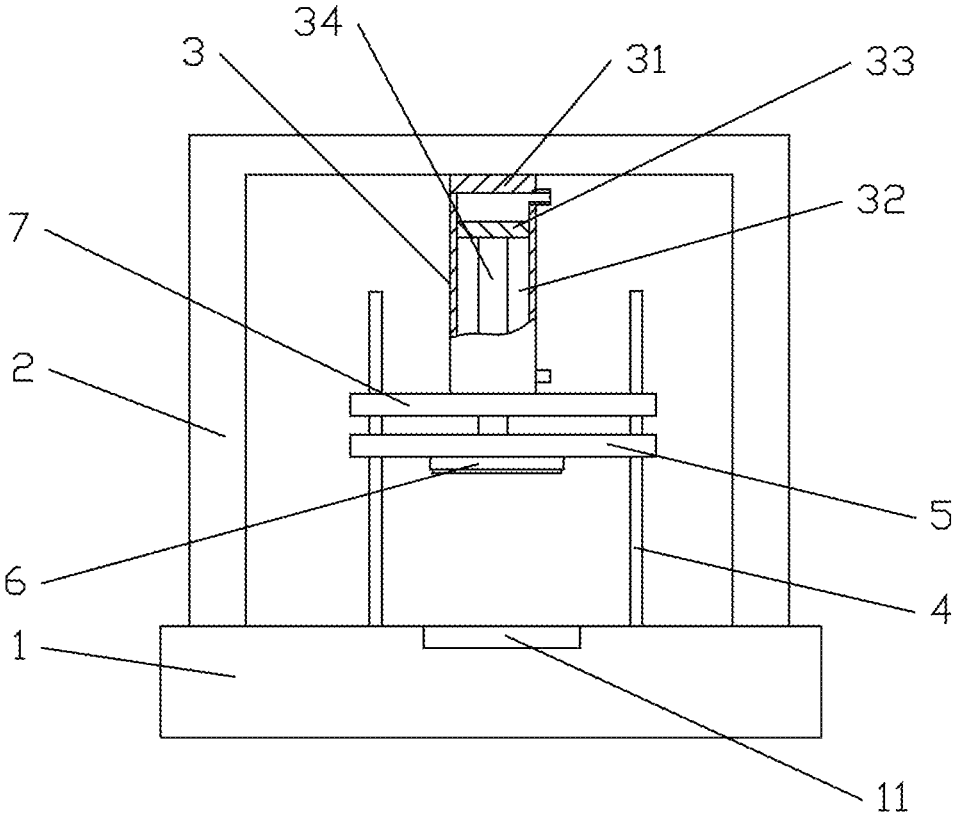
FIG. 1 is a front view illustrating a press-fit device as provided by an embodiment of the present invention.

Reference numerals: 1—platform; 11—bearing base; 2—mounting rack; 3—power cylinder; 31—cylinder block; 32—piston chamber; 33—piston; 34—piston rod; 35—actuating element; 4—guiding track; 5—press-fit plate; 6—pressure base; 61—flexible pressure frame; 611—pressure sensor; 62—pressure sensitive ball; 63—vac-sorb hole; 7—stablizing plate; 8—controller.

DETAILED DESCRIPTION OF THE PREFERRED EMBODIMENTS

In order to make objects, technical details and advantages of the embodiments of the invention apparent, technical solutions according to the embodiments of the present invention will be described clearly and completely as below in conjunction with the accompanying drawings of embodiments of the present invention. It is to be understood that the described embodiments are only a part of but not all of exemplary embodiments of the present invention. Based on the described embodiments of the present invention, various other embodiments can be obtained by those of ordinary skill in the art without creative labor and those embodiments shall fall into the protection scope of the present invention.

Unless otherwise defined, all the technical and scientific terms used herein have the same meanings as commonly understood by one of ordinary skill in the art to which the present invention belongs. The terms, such as "first," "second," or the like, which are used in the description and the claims of the present application, are not intended to indicate any sequence, amount or importance, but for distinguishing various components. Also, the terms, such as "comprise/comprising," "include/including," or the like are intended to specify that the elements or the objects stated before these terms encompass the elements or the objects and equivalents thereof listed after these terms, but not preclude other elements or objects. The terms, "on," "under," or the like are only used to indicate relative position relationship, and when the position of the object which is described is changed, the relative position relationship may be changed accordingly.

First Embodiment

Figure 2:
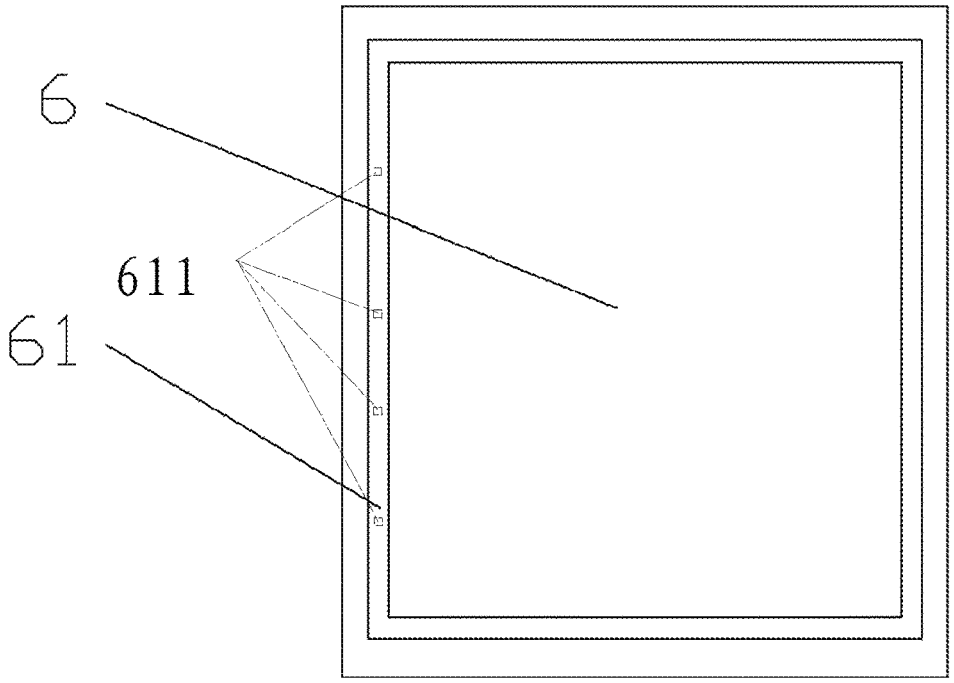
FIG. 2 is a front view illustrating an example of a pressure base of a press-fit device as provided by an embodiment of the present invention.
Figure 3:
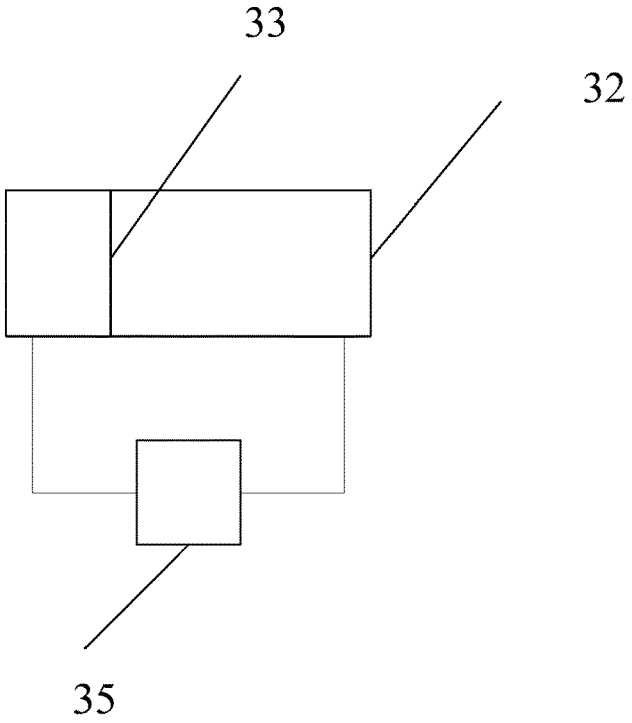
FIG. 3 is a schematic diagram illustrating a connection between a piston chamber and an actuating element of a press-fit device as provided by an embodiment of the present invention.

Referring to FIGS. 1-3, a press-fit device as provided by an embodiment of the present invention includes a platform 1, a mounting rack 2, a power cylinder 3, a guiding track 4 and a press-fit plate 5. An upper surface of the platform 1 is provided with a bearing base 11. The mounting rack 2 is disposed at the upper surface of the platform 1. The power cylinder 3 includes: a cylinder block 31 provided with a piston chamber 32; a piston 33 slidably disposed in the piston chamber 32; a piston rod 34 having a rear end connected to the piston 33; and an actuating element 35 (not illustrated in FIGS. 1-2 but in FIG. 3) intercommunicated with the piston chamber 32 to supply the piston chamber 32 with pressure medium and control a pressure in the piston chamber 32; wherein, the cylinder block 31 is disposed at the mounting rack 2, and the piston rod 34 is perpendicular to the bearing base 11; the piston chamber 32 is divided into two compartments by the piston 33, and the actuating element 35 are intercommunicated with the two compartments, respectively, to supply both of the two compartments with pressure medium so as to control a pressure in the piston chamber 32 and hence to control a pressure applied to the outside by the piston rod 34. The guiding track 4 is disposed on the upper surface of the platform 1 and is arranged in parallel to the piston rod 34. The press-fit plate 5 is disposed at a front end of the piston rod 34 and is slidably sheathed on the guiding track 4 so as to move along the guiding track 4 driven by the power cylinder 3. A bottom surface of the press-fit plate 5 is provided with a pressure base 6 corresponding to the bearing base 11, and a bottom surface of the pressure base 6 is provided with a pressure frame 61 and a pressure sensing device which is configured to measure a press-fit pressure. An air cylinder or an oil cylinder can be utilized as the power cylinder 3, wherein the air cylinder especially can ensure a safety of production environment because it has no way of resulting in oil leakage which pollutes the environment.

In an example of the present embodiment, as illustrated in FIG. 3, the actuating element 35 includes an air pump (not illustrated) and an electromagnetic valve (not illustrated), and can supply the piston chamber 32 with pressure gas through the electromagnetic valve and a switch of the air pump, so as to control a pressure output by the piston rod 34. The air pump and the electromagnetic valve in this example are well-known devices for those skilled in the art, and the structure or working principle thereof will be omitted herein.

In an example of the present embodiment, the pressure base 6 is detachably mounted at the press-fit plate 5, which allows a replacement of pressure base with different sizes according to a size of the panel to be press-fitted.

In an example of the present embodiment, the pressure sensing device can be connected to a display which is configured to display a pressure value as measured by the pressure sensing device. During operation, one can view the pressure value as measured by the pressure sensing device through the display so as to control a pressure of the pressure medium in the piston chamber of the cylinder block according to the pressure value; in this way, it can realize a real-time monitor of the press-fit pressure so as to ensure a complete press-fit between the panel and the backlight module.

During the operation of the press-fit device as provided by the embodiment of the present invention, the backlight module and the panel are successively placed onto the bearing base 11; upon starting the power cylinder 3, the piston rod 34 pushes the press-fit plate 5 to move towards the platform 1, which allows the pressure base 6 to move towards the bearing base 11 so as to press-fit the panel with the backlight module. During the press-fit process, the pressure sensing device measures the press-fit pressure in real time, which allows adjusting the actuating element based on the real-time press-fit pressure so as to regulate the press-fit pressure; in this way, the backlight module and the panel can be completely bonded with each other and the product yield can be improved.

In an example of the present embodiment, two guiding tracks 4 can be disposed at two sides of the piston rod 34, respectively. In such case, the press-fit device can further include a stabilizing plate 7 which is disposed on the two guiding tracks 4 and is connected to the cylinder block 31. With the use of the stabilizing plate 7, the guiding track 4 can be connected to the cylinder block 31, so as to reduce a shaking of the piston rod during stretching out and drawing back, which improves a movement stability of the press-fit plate and ensures a complete press-fit.

In an example of the present embodiment, a gantry can be utilized as the mounting rack 2. In such case, the cylinder block 31 can be disposed at a bottom surface of a beam in the gantry.

In an example of the present embodiment, as illustrated in FIG. 2, the pressure sensing device includes a plurality of pressure sensors 611 uniformly arranged along the press-fit frame 61. For example, the press-fit frame 61 can be formed of soft plastic or rubber, so as to facilitate mounting the pressure sensors 611 at the press-fit frame 61, for example, embedding the pressure sensors 611 into the press-fit frame 61. The pressure values as measured by the pressure sensors 611 disposed at various locations can reflect a flatness condition of the product in real time during the press-fit process. It should be explained that, FIG. 2 merely illustrates 4 pressure sensors 611 uniformly arranged along a single side edge of the press-fit frame 61 for simplicity. Those skilled in the art will be appreciated that, in other embodiments, the pressure sensors 611 can be arranged on more than one side edge of the press-fit frame 61, including or excluding the side edge illustrated in FIG. 2, and can be arranged on each side edge at an amount larger or smaller than that illustrated in FIG. 2, according to demands of industrial production without limiting the present invention thereto.

Figure 4:
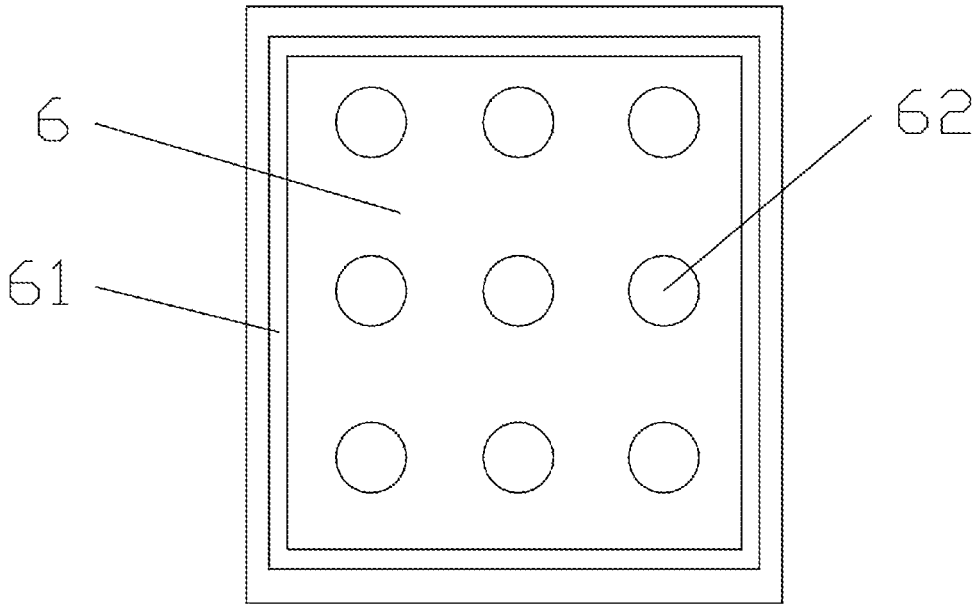
FIG. 4 is a front view illustrating another example of a pressure base of a press-fit device as provided by an embodiment of the present invention.

In an example of the present embodiment, as illustrated in FIG. 4, the pressure sensing device can further include a plurality of pressure sensitive balls 62 which are uniformly arranged in an array on a lower surface of the pressure base 6. FIG. 4 illustrates 9 pressure sensitive balls 62 which are arranged in a matrix on the lower surface of the pressure base 6. However, embodiments of the present invention are not limited thereto. By utilizing pressure sensitive balls 62 and by presenting a press-in status of respective pressure sensitive balls 62 through the display, it can reflect a flatness condition of the product in real time during the press-fit process.

Figure 5:
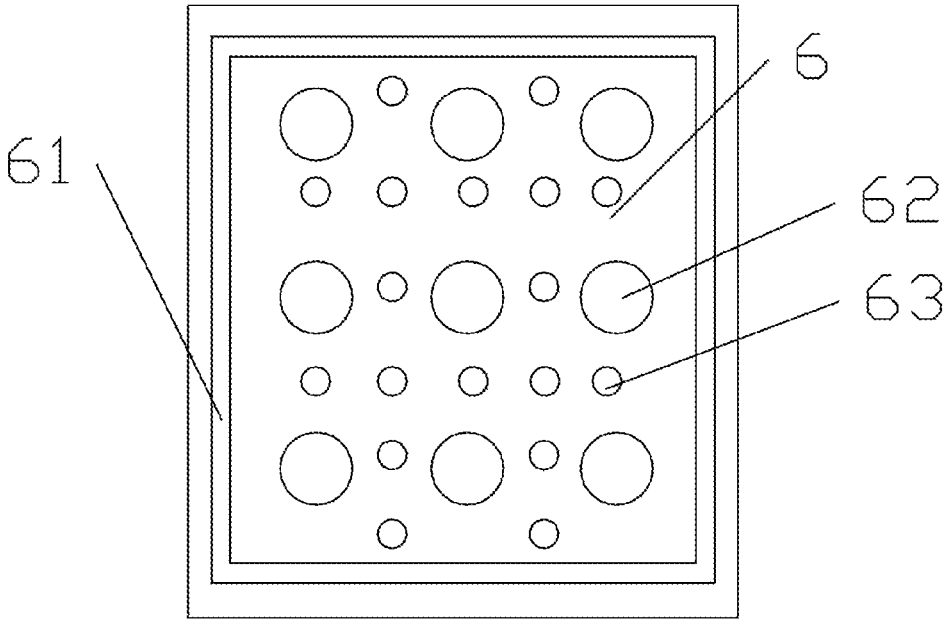
FIG. 5 is a front view illustrating yet another example of a pressure base of a press-fit device as provided by an embodiment of the present invention.

In an example of the present embodiment, as illustrated in FIG. 5, the pressure base 6 is provided with a plurality of vac-sorb holes 63 which can be connected to an external sorption pump. In this way, during the press-fit process, the pressure base 6 can absorb the panel through the vac-sorb holes 63, so as to prevent the panel from moving and hence to ensure a complete press-fit.

Second Embodiment

Figure 6:
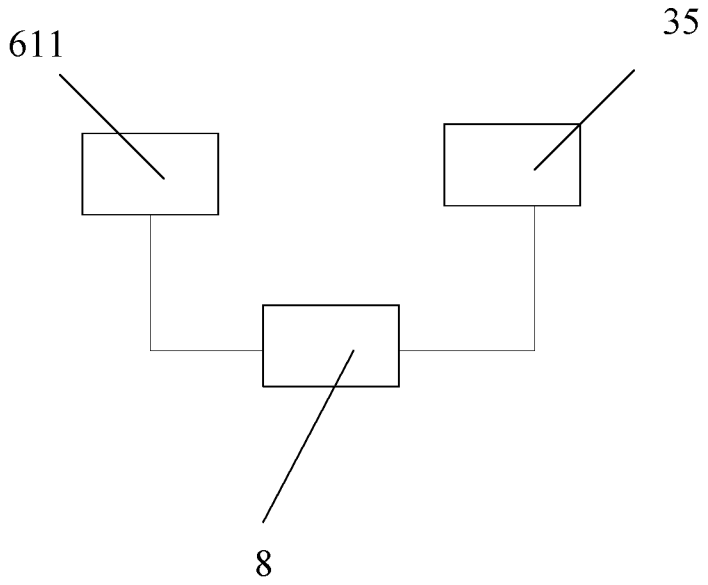
FIG. 6 is a schematic diagram illustrating a connection between a controller, a pressure sensing device and an actuating element of a press-fit device as provided by another embodiment of the present invention.

The press-fit device as provided by the present embodiment has structure and configuration almost the same with that of the first embodiment except that the press-fit device in the present embodiment further includes a controller 8, as illustrated in FIG. 6. The controller 8 has an input end communicatively connected to the pressure sensing device (e.g., the pressure sensor 611) and an output end connected to the actuating element 35 so as to control the pressure in the piston chamber.

In an example of the present embodiment, the controller can be stored with a pre-determined, standard press-fit pressure value. Upon inputting the real-time pressure value as measured by the pressure sensing device into the controller, the controller compares the real-time pressure value with the pre-determined standard press-fit pressure value as stored; if the real-time pressure value is greater than the standard pressure value, the controller controls the actuating element to operate to reduce the pressure in the piston chamber; and if the real-time pressure value is smaller than the standard pressure value, the controller controls the actuating element to operate to raise the pressure in the piston chamber so as to increase the press-fit pressure; in this way, it can ensure that the press-fit pressure satisfies demands of design, so as to ensure a complete press-fit between the backlight module and the panel and to improve the product yield.

It should be explained that, in the present embodiment, the pressure sensing device may not be connected to a display.

Third Embodiment

Figure 7:
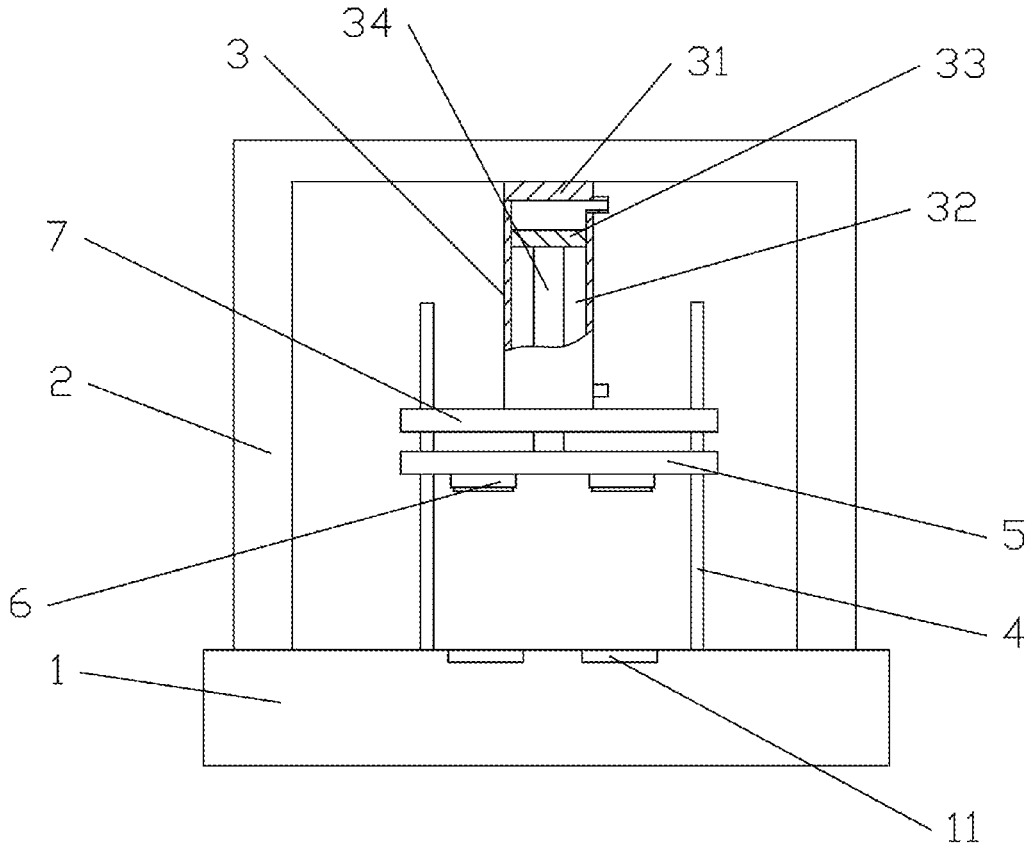
FIG. 7 is a front view illustrating a press-fit device as provided by another embodiment of the present invention.

The press-fit device as provided by the present embodiment has structure and configuration almost the same with that of the first embodiment except that the press-fit device in the present embodiment is provided with a plurality of bearing bases 11 and a plurality of pressure bases 6 which are arranged in one-to-one correspondence, as illustrated in FIG. 7. FIG. 7 illustrates two bearing bases 11 and correspondingly two pressure bases 6, wherein the two pressure bases 6 are arranged in symmetry about an axis of the piston rod 34; however, embodiments of the present invention are not limited thereto. In various examples of the present embodiment, both of the pressure base and the bearing base can be provided at an amount of $2^N$, wherein N is 0, 1, 2, . . .

It is understood that the described above are just exemplary implementations and embodiments to explain the principle of the present invention and the invention is not intended to be limited thereto. An ordinary person in the art can make various variations and modifications to the present invention without departure from the spirit and the scope of the present invention, and such variations and modifications shall fall in the scope of the present invention.

The present application claims the priority of China patent application No. 201510205274.9 filed on Apr. 24, 2015 titled "PRESS-FIT DEVICE", which is incorporated herein by reference in its entirely.

What is claimed is:

1. A press-fit device, comprising:

a platform having an upper surface provided with a bearing base;

a mounting rack disposed at the upper surface of the platform;

a power cylinder mounted at the mounting rack and located above the bearing base, including a piston chamber, a piston rod and an actuating element intercommunicated with the piston chamber to supply the piston chamber with pressure medium and control a pressure in the piston chamber, wherein the piston rod is perpendicular to the bearing base;

a guiding track disposed at the upper surface of the platform and arranged in parallel to the piston rod; and a press-fit plate disposed at one end of the piston rod and slidably sheathed on the guiding track, wherein a surface of the press-fit plate facing the bearing base is provided with a pressure base corresponding to the bearing base, and a surface of the pressure base facing the bearing base is provided with a press-fit frame and a pressure sensing device, wherein the pressure sensing device is configured to detect a press-fit pressure, and wherein the pressure sensing device comprises a plurality of pressure sensors which are uniformly arranged along the press-fit frame.

2. The press-fit device of claim 1, further comprising a controller, wherein the controller has an input end communicatively connected to the pressure sensing device and an output end connected to the actuating element so as to control the pressure in the piston chamber.

3. The press-fit device of claim 1, wherein the bearing base and the pressure base are provided in plural, respectively, and a plurality of bearing bases and a plurality of pressure bases are disposed in one-to-one correspondence.

4. The press-fit device of claim 1, wherein the pressure sensing device further comprises a plurality of pressure sensitive balls which are uniformly arranged in an array on the surface of the pressure base facing the bearing base.

5. The press-fit device of claim 1, wherein the pressure base is provided with a plurality of vac-sorb holes.

6. The press-fit device of claim 1, wherein two guiding tracks are disposed at two sides of the piston rod, respectively.

7. The press-fit device of claim 6, further comprising a stabilizing plate, wherein the stabilizing plate is disposed on the two guiding tracks and is connected to the power cylinder.

8. The press-fit device of claim 1, wherein the mounting rack is a gantry.

9. The press-fit device of claim 1, wherein the power cylinder is selected from the group consisting of an oil cylinder and an air cylinder.

* * * * *